US005271720A

United States Patent [19]

Wall

[11] Patent Number: 5,271,720

[45] Date of Patent: Dec. 21, 1993

[54] ROTARY VANE PUMP WITH SUPPLEMENTAL PUMPING MEANS

[75] Inventor: Robin C. Wall, Kent, England

[73] Assignee: Lucas Industries public limited company, West Midlands, England

[21] Appl. No.: 998,379

[22] Filed: Dec. 30, 1992

[30] Foreign Application Priority Data

Jan. 31, 1992 [GB] United Kingdom ..... 9202083

[51] Int. Cl.[5] ..... F04B 23/10

[52] U.S. Cl. ..... 417/204; 417/313; 418/267

[58] Field of Search ..... 417/313, 204; 418/259, 418/268, 267

[56] References Cited

U.S. PATENT DOCUMENTS

| | | | |
|---|---|---|---|
| 2,861,517 | 11/1958 | Neff | 418/267 |
| 2,967,489 | 1/1961 | Harrington . | |
| 3,120,154 | 2/1964 | Gilreath | 418/267 |
| 3,223,044 | 12/1965 | Adams et al. | 418/267 |
| 4,374,632 | 2/1983 | Wilcox | 418/267 |
| 4,521,167 | 6/1985 | Cavalleri et al. | 418/268 |

FOREIGN PATENT DOCUMENTS

| | | | |
|---|---|---|---|
| 0057309 | 8/1982 | European Pat. Off. . | |
| 0068354 | 1/1983 | European Pat. Off. . | |
| 4035464 | 5/1992 | Fed. Rep. of Germany | 418/268 |
| 2596107 | 9/1987 | France | 418/259 |
| 78489 | 4/1987 | Japan | 418/259 |
| 989144 | 1/1983 | U.S.S.R. | 418/259 |

*Primary Examiner*—Richard A. Bertsch
*Assistant Examiner*—Roland G. McAndrews, Jr.
*Attorney, Agent, or Firm*—Trexler, Bushnell, Giangiorgi & Blackstone, Ltd.

[57] ABSTRACT

A vane pump has a plurality of outwardly spring loaded vanes mounted within slots respectively formed in a rotor. The internal surface of the stator of the pump is of cylindrical form, and end plates at the opposite ends of the rotor and stator have inlet and outlet ports formed therein. Each vane is provided with a transfer port which communicates with the inner end of the associated slot and the transfer port is positioned to register with the inlet and outlet ports so that the movement of the vanes within the slots contributes to the pumping action.

4 Claims, 1 Drawing Sheet

ROTARY VANE PUMP WITH SUPPLEMENTAL PUMPING MEANS

This invention relates to vane pumps of the kind comprising a rotor which defines a plurality of radial slots which extend axially of the rotor, a plurality of vanes slidable in the slots respectively, the rotor being located between a pair of side plates and a surrounding stator with the outer edges of the vanes engaging the internal surface of the stator and said surface being arranged so that as the rotor is rotated, liquid will be drawn through an inlet port and expelled through an outlet port.

The object of the invention is to provide a pump of the kind specified in a simple and convenient form.

According to the invention in a vane pump of the kind specified the internal surface of the stator is of cylindrical form and the vanes are spring loaded into engagement with the surface, the surfaces of the outer edges of the vanes being of convex form and each vane defining in an end wall adjacent the outer edge of the vane, a transfer port which communicates with the inner end of the associated slot, said transfer port being positioned so as to register in turn with the inlet and outlet ports.

One example of a vane pump in accordance with the invention will now be described with reference to the accompanying drawings in which.

Figure 1:
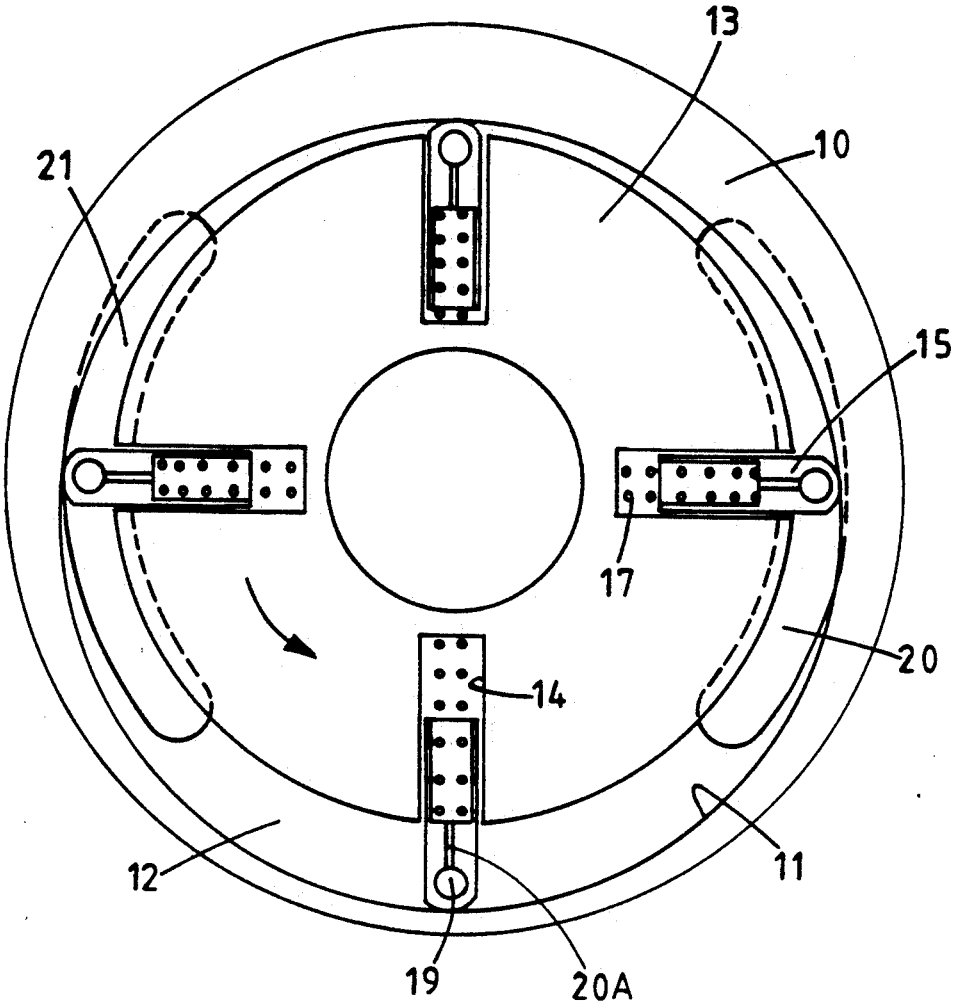
FIG. 1 is an end view of the rotor with a part removed.

Referring to the drawings the pump comprises a hollow stator 10 the internal surface 11 of which is of cylindrical form. Located at each end of the stator is an end plate 12 and located within the stator is a rotor 13 having its axis of rotation offset relative to the axis of the cylindrical surface 11.

Figure 2:
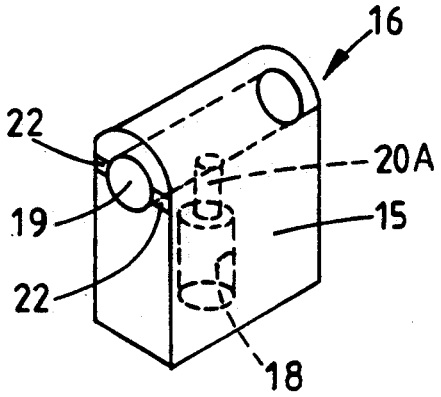
FIG. 2 is a perspective view of a part of the pump seen in FIG. 1.

Formed in the rotor are four equi-angularly disposed radially extending slots 14 which extend the length of the rotor and located within the slots respectively are four vanes 15. As seen in FIG. 2, the surfaces of the outer edges 16 of the vanes are of convex form for engagement with the internal surface 11 and each vane is spring loaded outwardly by means of a coiled compression spring 17 which engages the base wall of the associated slot 14 and which is partly accommodated within a cylindrical chamber 18 formed in the vane. It should be noted that other forms of spring may be utilised for example, leaf springs.

Each vane is provided in one or both end surfaces, with a transfer port or ports formed by the end or ends of a drilling 19 which extends lengthwise through the vane adjacent the outer edge and the drilling is in communication with the aforesaid chamber 18 by way of a passage 20A.

The end plates 12 each define an elongated outlet port 20 and an elongated inlet port 21 and in use, when the rotor is rotated in the direction indicated by the arrow, liquid will be drawn through the inlet port 21 and displaced through the outlet port 20 in the usual manner of a vane pump. In addition, the transfer port of the vane which is traversing the inlet port 21 will be in communication with the inlet port so that liquid can flow as the vane is moved outwardly by its spring into the inner end of the slot 14 and as the vane is traversing the outlet port 20, the transfer port will be in register therewith so that during inward movement of the vane fluid will flow from the inner end of the slot 14 to the outlet port. The displacement of the pump is therefore supplemented by the fact that the vanes act as pistons.

Since the inlet and outlet ports 21, 20 are of a limited length, and since some inward and outward movement of the vanes takes place during the movement of a vane between the end of the inlet port and the adjacent end of the outlet port and vice versa, it is important to ensure that the vanes should be able to move in order that the outer edges of the vanes do not leave the cylindrical surface otherwise leakage will occur within the pump.

The required condition will occur if the force produced by the pressure within the respective slot 14 acting on the inner surface area of the vane together with the force exerted by the spring is sufficient to overcome the force generated by the pressure at the outlet port 20 acting on approximately half the area of the curved outer edge of the vane.

In this condition the liquid path past the sides of the blade which is restricted due to the close clearance of the end plates 12, will cause a flow of liquid into the transfer port and a pressure will be established in the slot which will be approximately the average of the inlet and outlet pressures. The pressure in the outlet port 20 will act on a portion of the curved outer edge of the vane in practice slightly less than half the area, due to a slight tilting of the blade within its slot.

As the lowermost vane in the drawing moves towards the outlet port 20 it will be moved inwardly within its slot and liquid will be displaced from the slot to the outlet port 20 and some will be lost by leakage to the low pressure space. The displacement of the pump is therefore supplemented by some of the liquid which is displaced from the slot.

If the pump is constructed to very tight tolerances so that there is little clearance between the ends of the vanes and the end plates 12, and hence insufficient leakage to establish the desired average pressure in the slots, small grooves as seen at 22 in FIG. 2, in the end walls of the blades may be provided.

I claim:

1. A vane pump comprising a hollow stator having an internal surface and a rotor within said stator having a plurality of radial slots opening onto its periphery, a pair of side plates at the opposite ends of the rotor, and a plurality of vanes slidable in the slots respectively, the outer edges of the vanes engaging the internal surface of the stator, said surface of the stator being arranged so that as the rotor is rotated liquid will be drawn through an inlet port and expelled through an outlet port, said internal surface of the stator being of cylindrical form and the vanes being spring loaded outwardly into engagement with the surface by means of respective springs, surfaces of the outer edges of the vanes being of convex form in a plane extending perpendicular to the rotor axis and radially outward along said vane, and each vane having a transfer port defined in an end wall adjacent the outer edge of the vane, said transfer port communicating with the inner end of the associated slot and being positioned so as to register in turn with the inlet and outlet ports.

2. A vane pump according to claim 1, in which said transfer port is defined by a drilling which extends lengthwise through the vane, said drilling communicating with the inner end of the associated slot.

3. A vane pump according to claim 2, in which said drilling communicates with the inner end of the associated slot by way of a chamber formed in the vane and which partly accommodates a spring.

4. A vane pump according to claim 2, including grooves formed in an end wall of each vane, said grooves communicating with the transfer port, and acting to maintain restricted communication with the spaces on opposite sides of the vanes.

* * * * *